US006363905B1

(12) United States Patent
Davis

(10) Patent No.: US 6,363,905 B1
(45) Date of Patent: Apr. 2, 2002

(54) FLEXIBLE OIL FILL TUBE

(75) Inventor: Steven T. Davis, Green Bay, WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/699,673

(22) Filed: Oct. 30, 2000

(51) Int. Cl.[7] ..... F01M 1/00
(52) U.S. Cl. ..... 123/196 R; 184/1.5
(58) Field of Search ..... 123/196 R; 184/1.5, 184/105.1

(56) References Cited

U.S. PATENT DOCUMENTS

| | | | | |
|---|---|---|---|---|
| 1,210,385 | A | 12/1916 | Hunziker | |
| 1,717,188 | A | 6/1929 | Ciomei | |
| 2,216,360 | A | 10/1940 | Sweetland | 184/1.5 |
| 2,750,003 | A | 6/1956 | Smith | 184/105 |
| 2,953,939 | A | 9/1960 | Rains | 74/606 |
| 3,103,947 | A | 9/1963 | Mueller | 137/351 |
| 3,181,745 | A | 5/1965 | Grobowski | 222/539 |
| 3,858,686 | A | 1/1975 | Luterick | 184/1.5 |
| 4,033,432 | A | 7/1977 | Bernstein | 184/1.5 |
| 4,403,466 | A | 9/1983 | Tillotson et al. | 56/16.7 |
| 4,832,238 | A | 5/1989 | Taylor | 222/529 |
| 4,856,568 | A | 8/1989 | Murphy et al. | 141/337 |
| 5,020,702 | A | 6/1991 | James | 222/529 |
| 5,074,379 | A | 12/1991 | Batrice | 184/1.5 |
| 5,228,536 | A | 7/1993 | Mohns | 184/1.5 |
| 5,386,881 | A | 2/1995 | Eshelman | 184/1.5 |
| 5,505,643 | A | 4/1996 | Prasse | 440/88 |
| 5,975,156 | A | 11/1999 | Senour | 141/98 |
| 5,975,157 | A | 11/1999 | Ashford | 141/98 |

*Primary Examiner*—Noah P. Kamen
(74) *Attorney, Agent, or Firm*—Baker & Daniels

(57) ABSTRACT

An oil fill tube for an internal combustion engine, the engine including an oil sump contained therein. The oil fill tube is axially flexible, and includes an extendable and contractable accordion section intennediate first and second ends, the first end sealingly affixed to a fill hole in the engine housing such that oil may be filled through the oil fill tube into the oil sump. The flexible, extendable, and contractable accordion section of the oil fill tube allows a single oil fill tube to be used with a variety of differently sized engines, and also dampens relative vibration between the crankcase and shroud of the engine housing to reduce tension on the fitting between oil fill tube and crankcase and to prevent oil leakage therethrough from the oil sump. A variety of fittings between oil fill tube and crankcase provide a secure, leak-resistant connection therebetween.

14 Claims, 3 Drawing Sheets

FLEXIBLE OIL FILL TUBE

BACKGROUND OF THE INVENTION

1. Field of the Invention

The field of the present invention relates to internal combustion engines used with push lawnmowers, lawn and garden implements, or in small utility vehicles such as riding lawnmowers, lawn tractors and the like. In particular, the invention relates to an oil fill tube attached to the engine housing in fluid communication with the oil sump of the engine.

2. Description of the Related Art

Known internal combustion engines often include a rigid oil fill tube which is attached by a fitting to the engine crankcase in fluid communication with an oil sump contained within the engine crankcase, with the upper end of the oil fill tube attached to a bracket mounted on the engine shroud or blower housing. In order to fill oil into the crankcase, a cap on the upper end of the oil fill tube is removed and oil is poured through the oil fill tube into the oil sump.

The engine shroud is attached to the engine crankcase and is made from a thin, flexible stamped metal or a flexible plastic. A problem is that, during the running of the engine, flexing of the shroud allows substantial relative vibration to occur between the crankcase and the shroud, which is often transmitted through the rigid oil fill tube, eventually causing the fitting which connects the oil fill tube to the crankcase to fail, causing oil to leak from the oil sump though the fitting. This problem is exacerbated during running of the engine when the engine crankcase is pressurized by the reciprocation of the piston(s) therein, which forces oil through the failed fitting and out of the crankcase.

An additional disadvantage of this design is that engines of varying size necessitate oil tubes of varying lengths, such that an oil fill tube of a given size is only useful with a complementary sized engine. Problematically, different sized oil fill tubes must be separately manufactured for engines of varying size, which increases manufacturing costs.

SUMMARY OF THE INVENTION

The present invention provides an oil fill tube for an internal combustion engine which includes an engine housing containing an oil sump therein, the oil fill tube capable of flexing axially between first and second ends thereof, the first end of the oil fill tube sealingly attached to an oil fill hole in the engine housing in fluid communication with the oil sump, and the oil fill tube attached to an attachment member externally mounted on the engine housing.

The oil fill tube may include an accordion section having a plurality of flexible segment portions which enable the oil fill tube to be selectively flexed and bent into a variety of orientations, as well as allowing the oil fill tube to be extended and contracted between a variety of different lengths. Additionally, the oil fill tube may be attached to the engine housing via a variety of sealing, leak-resistant arrangements.

In a first such arrangement, the crankcase includes an oil fill hole with an adapter mounted therein, with an end of the oil fill tube threadingly attached to the adapter. In a second arrangement, the crankcase includes a boss defining an oil fill hole, with an end of the oil fill tube threadingly attached to the boss. In a third arrangement, the crankcase includes a boss defining an oil fill hole, and the oil fill tube includes a mounting flange spaced from an end thereof which is fastened to the boss with fasteners, with the end of the oil fill tube extending into the oil fill hole. In a fourth arrangement, the crankcase includes a boss defining an oil fill hole and having a first mounting flange, and the oil fill tube includes a second mounting flange spaced from an end thereof, with the first and second mounting flanges abutting one another and securely fastened together with a clamp with the end of the oil fill tube extending into the oil fill hole.

Advantageously, the oil fill tube may flex axially to isolate relative motion between the crankcase and the shroud, which flexing dampens the vibrations through the oil fill tube to reduce stress on the fitting between the oil fill tube and the crankcase. The oil fill tube may include a flexible, extendable and contractable accordion section having a plurality of segments which permit axial flexing of the oil fill tube. Additionally, each of the several fitting arrangements disclosed herein provide a tight and leak-resistant seal between the oil fill tube and the crankcase to reduce the possibility of oil leakage.

In addition, the axial flexing allowed by the extendable and contractable accordion section of the oil fill tube allows the oil fill tube to be selectively extended or contracted to accommodate a variety of differently sized engines, allowing a single oil fill tube to be manufactured which is compatible with a variety of differently sized engines, thereby reducing manufacturing costs.

In one form thereof, an internal combustion engine is provided, including a housing containing an oil sump and having a fill hole through which oil may be filled into the oil sump; an attachment member externally mounted on the housing; and an oil fill tube having an extendable and contractable accordion section intermediate first and second ends, the first end affixed to the fill hole in fluid communication with the oil sump with the oil fill tube attached to the attachment member.

In another form thereof, an internal combustion engine is provided, including a housing including a crankcase with a shroud attached thereto, the crankcase having an oil sump contained therein; an attachment member externally mounted on the shroud; and an oil fill tube retained by the attachment member, the oil fill tube including a first end attached to the crankcase in fluid communication with the oil sump and a second end through which oil may be filled into the oil sump, the oil fill tube capable of flexing axially to thereby aid in isolating relative motion between the shroud and the crankcase.

BRIEF DESCRIPTION OF THE DRAWINGS

The above-mentioned and other features and advantages of this invention, and the manner of attaining them, will become more apparent and the invention itself will be better understood by reference to the following description of several embodiments of the invention taken in conjunction with the accompanying drawings, wherein.

Corresponding reference characters indicate corresponding parts throughout the several views. The exemplifications set out herein illustrates one preferred embodiment of the invention, in one form, and such exemplification is not to be construed as limiting the scope of the invention in any manner.

DETAILED DESCRIPTION

Figure 1:
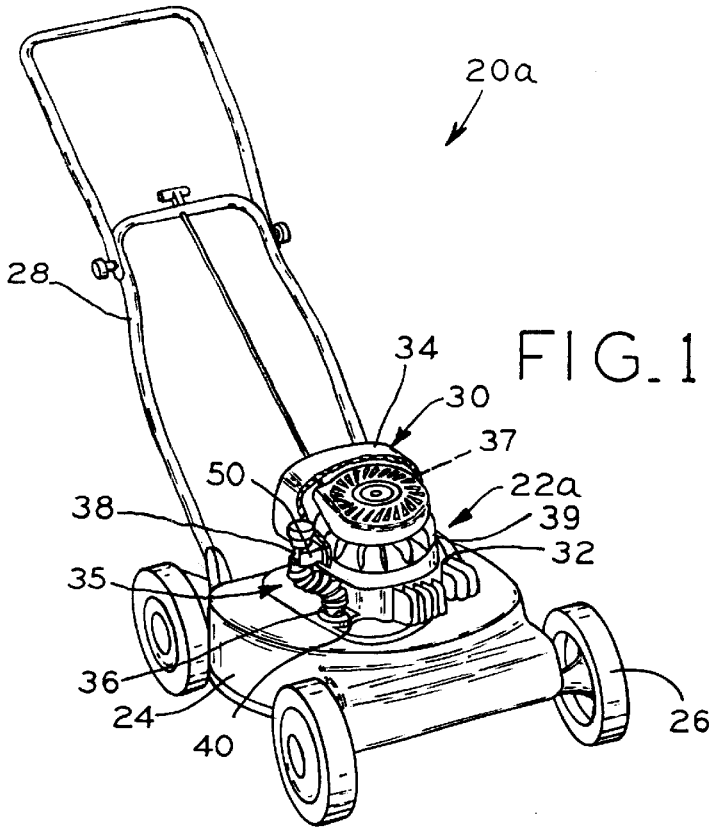
FIG. 1 is a perspective view of a lawnmower having a relatively smaller engine than the engine of the lawnmower of FIG. 2, including an oil fill tube in accordance with the present invention, the engine housing partially cut away to show the flywheel/blower.

Referring to FIG. 1, lawnmower 20*a* is shown, including engine 22*a* mounted to mower deck 24, with lawnmower 20*a* additionally including wheels 26 and handle 28 mounted to mower deck 24. Housing 30 of engine 22 a generally includes crankcase 32 and blower housing or shroud 34, with shroud 34 surrounding an upper portion of crankcase 32 which includes recoil starter 37, flywheel/blower 39, and other customary engine components (not shown). Alternatively, flywheel/blower 39 could comprise a separate flywheel and blower arrangement disposed beneath shroud 34. Oil fill tube 35 is attached to engine housing 30 such that lower end 36 of oil fill tube 35 is fitted within oil fill hole 40 of crankcase 32 in fluid communication with oil sump 42 (FIGS. 3B, 4B, 5B, and 6B) within crankcase 32. Upper end 38 of oil fill tube 35 is releasably retained by attachment member 50, which is externally mounted on the shroud 34 of engine housing 30, as explained in more detail below. Generally, however, oil fill tube 35 may be retained by attachment member 50 at any location on oil fill tube 35 between lower and upper ends 36, 38 thereof.

Figure 2:
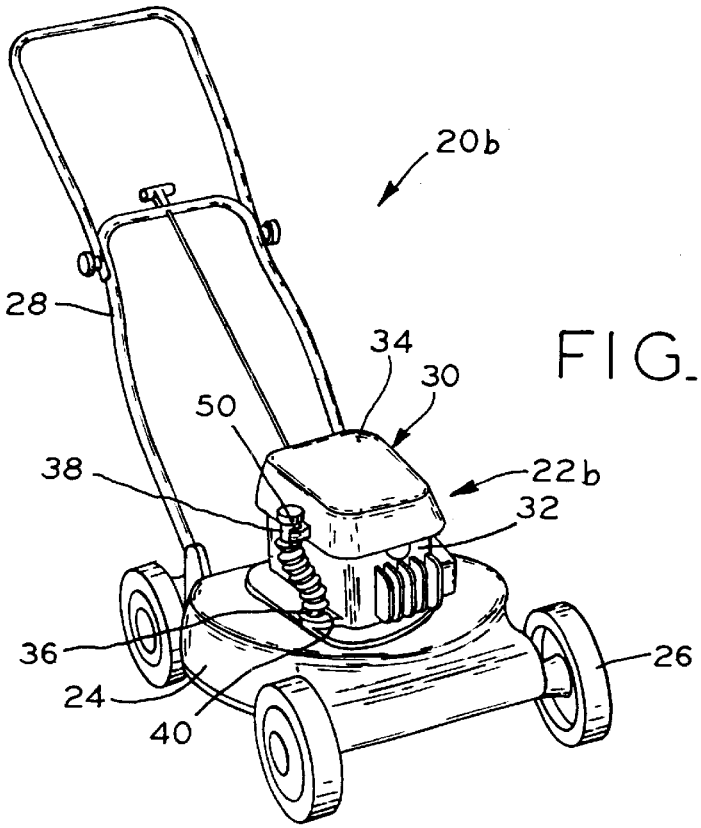
FIG. 2 is a perspective view of a lawnmower having a relatively larger engine than the engine of the lawnmower of FIG. 1, including the oil fill tube of FIG. 1 extended to accommodate the relatively larger engine.

Referring to FIG. 2, lawnmower 20*b* is shown, having engine 22*b* of a larger size than engine 22*a* of lawnmower 20*a* shown in FIG. 1. Although differently sized, engines 22*a* and 22*b* otherwise include similar components. Oil fill tube 35 is mounted to engine 22*b* in the same manner as that shown for engine 22*a* of FIG. 1. However, oil fill tube 35 is shown in FIG. 2 in an extended position in order to fit the larger engine 22*b*. As shown in FIGS. 1 and 2, oil fill tube 35 is used with engines 22*a* and 22*b* on lawnmowers 20*a* and 20*b*, respectively. However, it should be understood that oil fill tube 35 may be used with internal combustion engines in a variety of applications other than with lawnmower engines.

As shown in FIGS. 1 and 2, oil fill tube 35 generally includes a first or lower end 36 fitted into fill hole 40 of crankcase 32, and a second or upper end 38 opposite thereto through which oil may be filled into oil sump 42 of crankcase 32. Upper end 38 of oil fill tube 35 includes oil fill cap 44 threadingly attached thereto, which is removed for filling oil through oil fill tube 35 into oil sump 42 of crankcase 32.

Oil fill tube 35 may be made from a resilient, flexible plastic material, or alternatively, a combination of multiple types of plastic materials, which allow oil fill tube 35 to be bent into a variety of orientations as seen in FIGS. 1 and 2. Also, oil fill tube 35 is axially flexible to isolate relative motion between crankcase 32 and shroud 34, thereby dampening the vibrations between crankcase 32 and shroud 34 which might otherwise be transmitted through oil fill tube 35. As shown in FIGS. 3A, 4A, 5A, and 6A, oil fill tube 35 additionally includes a contractable and extendable accordion section 46 intermediate lower and upper ends 36, 38. Accordion section 46 is comprised of a plurality of individual, flexible segments 48.

Accordion section 46 is axially flexible, and may be selectively extended and contracted as shown in FIGS. 1 and 2, allowing a single oil fill tube 35 to be fitted for use with a variety of differently sized engines, such as engines 22*a* and 22*b*. As shown in FIGS. 3A, 4A, 5A, and 6A, oil fill tube 35 is also preferably releasably retained at a location intermediate upper and lower ends 38, 36 by an attachment member 50, which is externally mounted on shroud 34 with fasteners 52, for example. Attachment member 50 is shown in FIGS. 3A, 4A, 5A, and 6A as mounting bracket 54 having a pair of arms 56 extending therefrom between which oil fill tube 35 is releasably retained by an interference or snap-fit connection. The releasable connection between bracket 54 and oil fill tube 35 also aids in dampening vibrations which may be translated through oil fill tube 35 between crankcase 32 and shroud 34 of engine 22. The dampening of relative vibrations between shroud 34 and crankcase 32 of engine 22 reduces stress on fitting 58 between lower end of fill tube 35 and crankcase 32, thereby preventing failure of fitting 58 which would result in oil leakage from oil sump 42 of crankcase 32. Various fitting arrangements between lower end 36 of oil fill tube 35 and crankcase 32 are shown in FIGS. 3A through 6B.

Figure 3A:
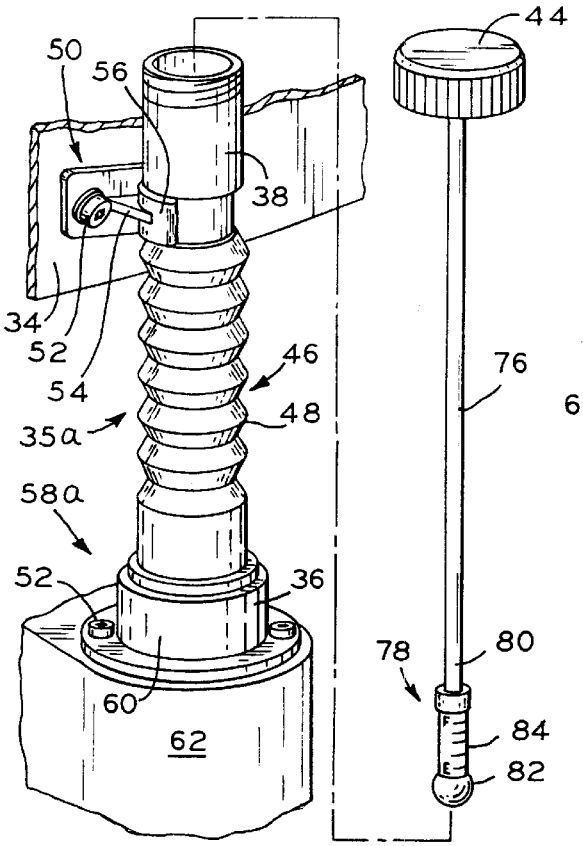
FIG. 3A is a perspective view illustrating a first fitting arrangement between the oil tube and the crankcase, and further showing the oil fill cap removed from the opposite end of the oil fill tube, the oil fill cap including a dipstick extending therefrom, the dipstick terminating in a weighted end tip with oil level markings thereon.
Figure 3B:
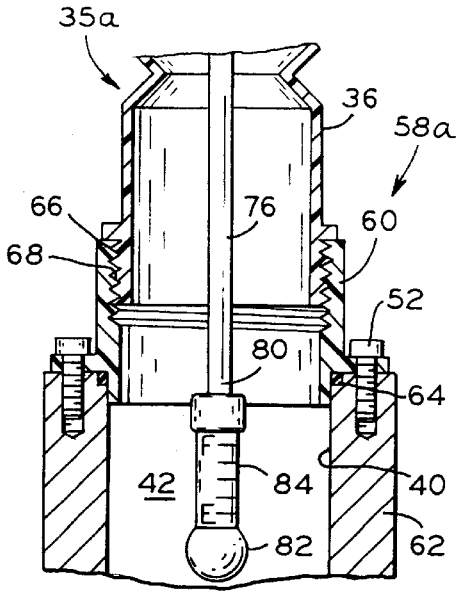
FIG. 3B is a fragmentary cross sectional view of the fitting arrangement of FIG. 3A.

Referring to FIGS. 3A and 3B, fitting 58 a includes adapter 60 fastened to boss 62 of crankcase 32. Boss 62 of crankcase 32 defines oil fill hole 40 in crankcase 32. Adapter 60 may be attached to boss 62 by fasteners 52, for example. Sealing member 64 is disposed between adapter 60 and boss 62, and aids in preventing oil leakage between crankcase 32 and oil fill tube 35*a*. Sealing member 64 is shown in FIGS. 3B, 4B, 5B and 6B as an O-ring, however, sealing member 64 may also be a gasket or other suitable sealing device. Referring again to FIGS. 3A and 3B, lower end 36 of oil fill tube 35 a includes external threads 66 which are threadingly engaged with internal threads 68 of adapter 60.

Figure 4A:
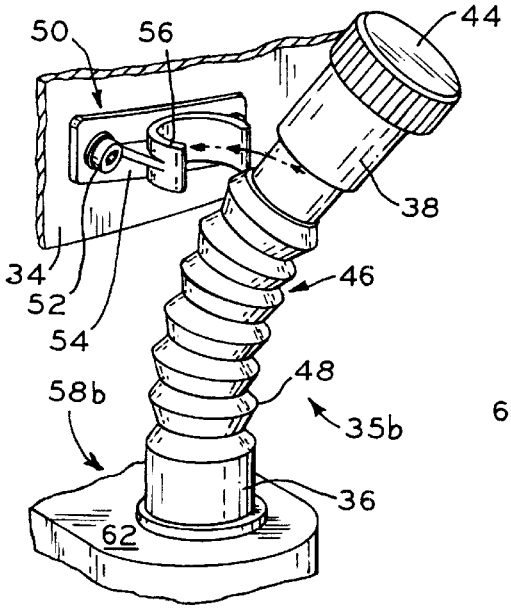
FIG. 4A is a perspective view showing a second fitting arrangement between the oil fill tube and the crankcase, and further showing the oil fill tube released from the mounting bracket.
Figure 4B:
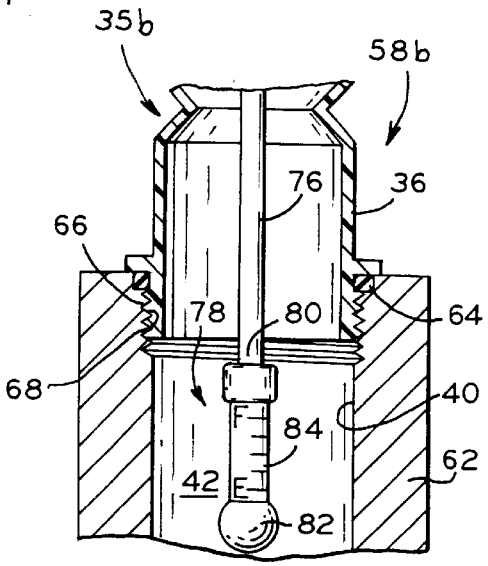
FIG. 4B is a fragmentary cross sectional view of the fitting arrangement of FIG. 4B.

Referring to FIGS. 4A and 4B, fitting 58*b* is shown, in which lower end 36 of oil fill tube 35*b* includes external threads 66 which are threadingly engaged with internal threads 68 of boss 62.

Figure 5A:
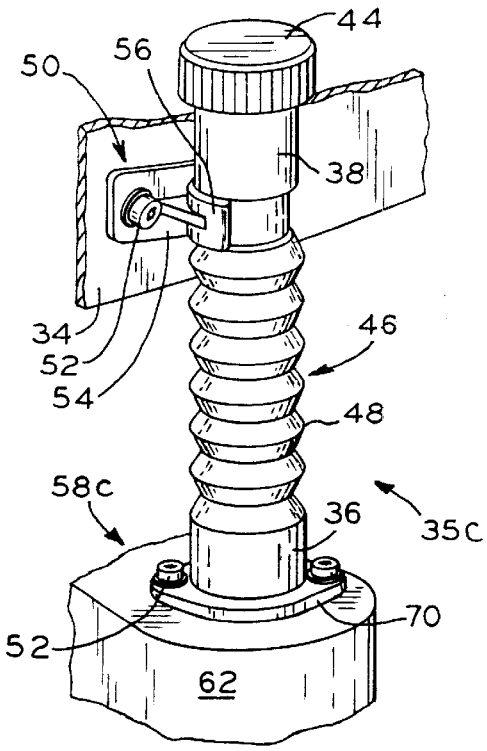
FIG. 5A is a perspective view showing a third fitting arrangement between the oil fill tube and the crankcase.
Figure 5B:
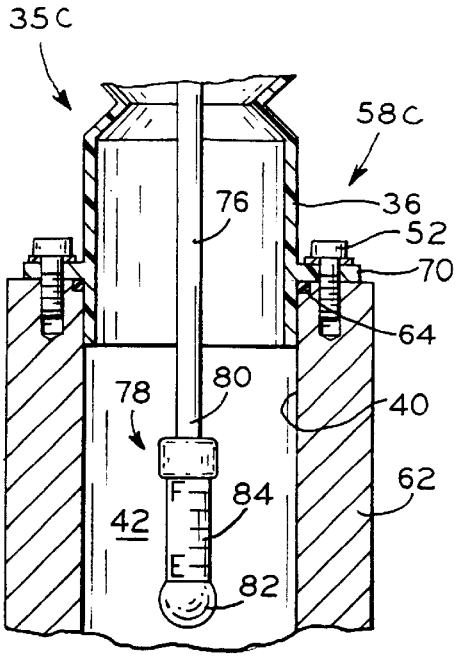
FIG. 5B is a fragmentary cross sectional view of the fitting arrangement of FIG. 5A.

Referring to FIGS. 5A and 5B, fitting 58*c* is shown, wherein lower end 36 of oil fill tube 35*c* includes integral mounting flange 70 attached by fasteners 52 to boss 62 of crankcase 32, with lower end 36 of oil fill tube 35*c* extending within oil fill hole 40 defined by boss 62.

Figure 6A:
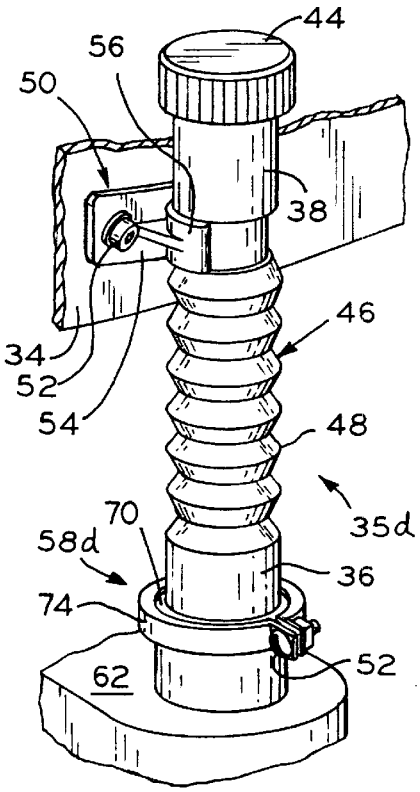
FIG. 6A is a perspective view showing a fourth fitting arrangement between the oil fill tube and the crankcase.
Figure 6B:
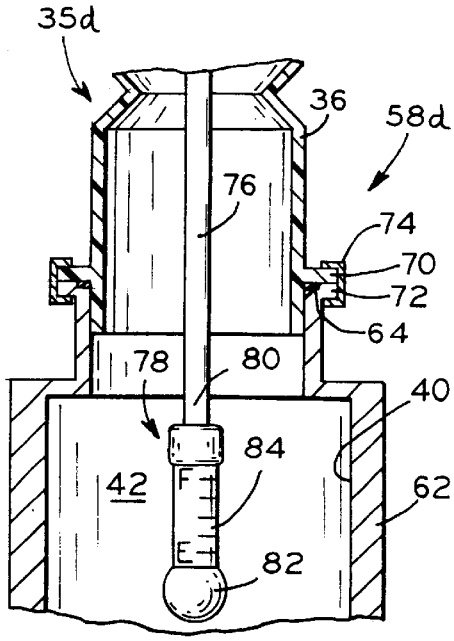
FIG. 6B is a fragmentary sectional view of the fitting arrangement of FIG. 6A.

Referring to FIGS. 6A and 6B, fitting 58*d* is shown. Boss 62 of crankcase 32 includes mounting flange 72, and defines oil fill hole 40 therethrough. Lower end 36 of oil fill tube 35*d* includes mounting flange 72 spaced therefrom, wherein mounting flanges 70 and 72 of boss 62 and oil fill tube 35, respectively, abut one another and are securely attached by C-clamp 74 and fastener 52, with lower end 36 of oil fill tube 35*d* extending within oil fill hole 40. Fittings 58*a–d*, shown in FIGS. 3A through 6B, each provide a leak-resistant connection between each of oil fill tubes 35*a–d* and crankcase 32, respectively.

As shown in FIG. 3A, oil fill cap 44 may include dipstick 76 protruding therefrom which, as shown in FIGS. 3B, 4B, 5B, and 6B, extends downwardly through oil fill tubes 35*a–d* into oil sump 42 of crankcase 32. Dipstick 76 may be formed of a plastic material integrally molded with oil fill cap 44, or may also comprise a braided wire section attached to oil fill cap 44 in a suitable manner. The length of dipstick 76 may be varied as needed, in order to be compatible with a desired length of oil fill tube 35, which is axially flexible as described above. Dipstick 76 also includes weighted end portion 78, which may be formed from any suitable metal crimped onto end 80 of dipstick 76. Weighted end portion 78 includes ball tip 82, which easily deflects from each segment portion 48 of accordion section 46 of oil fill tubes 35*a–d* as dipstick 76 is inserted therethrough, in order to prevent dipstick 76 from being caught or "hung up" within accordion section 46 as dipstick 76 is inserted therethrough. As shown in FIGS. 3B, 4B, 5B, and 6B, weighted end tip 78 extends into oil sump 42, and includes markings 84 thereon which correspond to "full", "empty", or intermediate levels of oil within oil sump 42, to enable a user to determine the level of oil within oil sump 42 when dipstick 76 is removed from oil fill tube 35.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine, comprising:

a housing containing an oil sump and having a fill hole through which oil may be filled into said oil sump;

an attachment member externally mounted on said housing; and an oil fill tube having an extendable and contractable accordion section intermediate first and second ends, said first end affixed to said fill hole in fluid communication with said oil sump with said oil fill tube attached to said attachment member.

2. The engine of claim 1, wherein said housing includes:

a crankcase containing said oil sump, and a shroud attached to said crankcase and enclosing a flywheel/blower, said attachment member attached to said shroud.

3. The engine of claim 1, wherein said accordion section comprises a plurality of flexible segments allowing said oil fill tube to be selectively bent into a variety of orientations.

4. The engine of claim 1, further comprising a sealing member disposed between said oil fill tube and said fill hole to provide a seal therebetween.

5. The engine of claim 1, wherein said fill hole includes an adapter mounted therein, with said first end of said oil fill tube threadingly attached to said adapter.

6. The engine of claim 1, wherein said housing includes a boss defining said fill hole, and said first end of said oil fill tube is threadingly attached to said boss.

7. The engine of claim 1, wherein said housing includes a boss defining said fill hole, and said oil fill tube includes a mounting flange spaced from said first end, said mounting flange fastened to said boss with said first end extending into said fill hole.

8. The engine of claim 1 wherein said housing includes a boss defining said fill hole and having a first mounting flange, and said fill tube includes a second mounting flange spaced from said first end, said first and said second mounting flanges abutting one another and fastened together with a clamp with said first end extending into said fill hole.

9. The engine of claim 1, wherein said attachment member comprises a bracket including a pair of arms within which said oil tube is releaseably fitted.

10. The engine of claim 1, wherein said oil fill tube includes a cap removably threaded onto said second end.

11. The engine of claim 10, wherein said cap includes a dipstick extending therefrom into said oil sump, said dipstick comprising:

a weighted tip portion; and a marking on said tip portion, said marking corresponding to a level of oil in said oil sump.

12. An internal combustion engine, comprising:

a housing including a crankcase, said crankcase having an oil sump contained therein;

a shroud enclosing a rotating flywheel and blower, said shroud attached to said housing; and an oil fill tube fastened to said shroud, said oil fill tube including a first end attached to said crankcase in fluid communication with said oil sump and a second end through which oil may be filled into said oil sump, said oil fill tube including an accordion section having a plurality of flexible segments which allow said oil fill tube to be contracted and expanded axially, said oil fill tube further capable of flexing axially to thereby aid in isolating relative motion between said shroud and said crankcase.

13. An internal combustion engine, comprising:

a housing including a crankcase, said crankcase having an oil sump contained therein;

a shroud enclosing a rotating flywheel and blower, said shroud attached to said housing;

an oil fill tube fastened to said shroud, said oil fill tube including a first end attached to said crankcase in fluid communication with said oil sump and a second end through which oil may be filled into said oil sump, said oil fill tube capable of flexing axially to thereby aid in isolating relative motion between said shroud and said crankcase; and wherein said crankcase includes a boss defining a fill hole, and said oil fill tube includes a mounting flange spaced from said first end, said mounting flange fastened to said boss with said first end extending into said oil fill hole.

14. An internal combustion engine, comprising:

a housing including a crankcase, said crankcase having an oil sump contained therein;

a shroud enclosing a rotating flywheel and blower, said shroud attached to said housing;

an oil fill tube fastened to said shroud, said oil fill tube including a first end attached to said crankcase in fluid communication with said oil sump and a second end through which oil may be filled into said oil sump, said oil fill tube capable of flexing axially to thereby aid in isolating relative motion between said shroud and said crankcase; and wherein said crankcase includes a boss defining a fill hole and having a first mounting flange, and said oil fill tube includes a second mounting flange spaced from said first end, said first and second mounting flanges abutting one another and fastened together with a clamp, with said first end extending into said fill hole.

* * * * *

UNITED STATES PATENT AND TRADEMARK OFFICE

CERTIFICATE OF CORRECTION

PATENT NO. : 6,363,905 B1
DATED : April 2, 2002
INVENTOR(S) : Steven T. Davis

It is certified that error appears in the above-identified patent and that said Letters Patent is hereby corrected as shown below:

Title page,
Item [57], ABSTRACT,
Line 4, delete "intennediate" and substitute therefor -- intermediate --.

Signed and Sealed this

Second Day of July, 2002

*Attest:*

*Attesting Officer*

JAMES E. ROGAN
*Director of the United States Patent and Trademark Office*